United States Patent [19]

Kern

[11] 4,255,982

[45] Mar. 17, 1981

[54] STARTER ASSEMBLY UTILIZING A CASTELLATED CUP

[75] Inventor: Calvin V. Kern, Maumee, Ohio

[73] Assignee: Eltra Corporation, Toledo, Ohio

[21] Appl. No.: 965,158

[22] Filed: Nov. 30, 1978

[51] Int. Cl.[3] ..... F02N 11/02

[52] U.S. Cl. ..... 74/7 R

[58] Field of Search ..... 74/6, 7 R, 9

[56] References Cited

U.S. PATENT DOCUMENTS

| | | | |
|---|---|---|---|
| 2,201,432 | 5/1940 | Fitzgerald | 74/7 R |
| 2,915,903 | 12/1959 | Digby et al. | 74/7 R |
| 3,071,013 | 1/1963 | Antonidis et al. | 74/7 R |
| 3,176,525 | 4/1965 | Rose | 74/7 R |

*Primary Examiner*—Philip C. Kannan

*Attorney, Agent, or Firm*—Oliver E. Todd, Jr.

[57] ABSTRACT

A starting motor pinion gear assembly comprises a powdered metal pinion disposed and retained within a castellated drawn metal cup having axially extending tangs which are staked between adjacent pinion teeth. The tangs are staked against a plurality of fillets or projections which extend radially outwardly from the bottom land of the pinion and form a discontinuous web between the pinion teeth adjacent one end of the pinion. Also disposed within the drawn cup is a splined drive collar which engages a mating spline on the output shaft of the starting motor and a torque limiting friction clutch. The pinion gear assembly mounts on the output shaft of the starting motor and momentarily engages a ring gear on the flywheel of an internal combustion engine to effect cranking of the engine.

10 Claims, 9 Drawing Figures

STARTER ASSEMBLY UTILIZING A CASTELLATED CUP

BACKGROUND OF THE INVENTION

The invention relates generally to a starting apparatus for cranking an internal combustion engine and more specifically to a pinion gear assembly for momentarily engaging an engine flywheel and transferring power from a starting motor to the internal combustion engine.

The concept and embodiments of automatically engaging and disengaging starting mechanisms for internal combustion engines are well known. A conventional menchanism comprises a plurality of teeth in the flywheel of an internal combustion engine or a ring gear secured to the crank shaft of such engine, juxtaposed a spring-biased pinion gear coupled to the output shaft of a starting motor through a helical spline. When the starting motor is activating and begins to rotate, the inertia of the pinion gear resists rotation and the helical spline causes the pinion to translate axially along the starting motor shaft and into engagement with the gear teeth on the engine crank shaft. The engine is thus cranked until the engine speed surpasses the speed at which the starting motor drives it, whereupon the spring biasing force and helical spline disengage the pinion gear from the engine gear.

Numerous modifications and improvements have been made to this basic mechanism. A particular difficulty of modifying this mechanism is the dimensional constraint placed on its size by associated components. Commonly, the starter mechanism will be positioned within a housing or adjacent engine components which closely limit its size. Therefore, unless redesign of the entire starting motor assembly and perhaps even engine components is permitted, refinements to the starter mechanism must be made within dimensional limits established by these associated components. The development of a new component or production technique thus leads to the additional consideration of adapting such an improvement to the presently utilized components.

A conventional starting motor pinion gear assembly includes an outer metal cup or shell which secures, in operating relationship, a spline follower, a resilient washer which functions as a friction clutch and the pinion gear itself. The cup is secured to the pinion gear and these components are frictionally driven through the clutch washer by the spline follower in the manner previously explained.

Prior art pinion gears are commonly hobbed or drop forged and may easily be attached to the drawn cup by conventional means such as welding or brazing as is taught by U.S. Pat. No. 3,071,013. The recently developed capability of forming the pinion gears of powdered metal and then sintering them, produces an improved pinion gear but creates difficulties with regard to the mode of attachment of the pinion to the drawn cup. Conventional welding and brazing techniques while ultimately capable of performing such a bonding operation, reliably do so only under carefully controlled conditions and the rejection rate of completed assemblies and the difficulties inherent in such a bonding process offset the advantages of a powdered metal pinion gear.

One attempt at solving the problem of securing the pinion to the drawn cup involves punching the radial face of the cup with a die conforming to the outline of the pinion gear, passing the pinion through the punched opening in the cup and retaining it within the cup by means of a radially extending ridge adjacent one end of the pinion. If the diameter of the drawn cup is sufficiently large to permit the pinion gear to be passed within its inside diameter, this approach is viable. However, as the number of teeth on the pinion gear and its outside diameter increase, this mounting approach becomes unusable inasmuch as either there is insufficient material on the radial face of the cup to either punch or insure proper retention of the pinion or the outside diameter of the pinion exceeds the inside diameter of the cup. In the largest pinions, typically having 11 teeth, the outer diameter of the pinion is nearly identical to the outer diameter of the drawn cup and the punched radial face mounting scheme is patently unusable. Due to the dimensional constraints of the associated components noted previously, enlarging the diameter of the drawn cup to accept and secure the pinions is, likewise, an approach which is not viable.

SUMMARY OF THE INVENTION

The instant invention is directed to a starting motor pinion gear assembly which comprises a castellated drawn cup which accepts and retains pinion gears having various outer diameters; the largest outer diameter gear being substantially as large as the cup itself. The cup includes a plurality of axially extending tangs equal in number to the number of teeth on the pinion which are staked over projections from the bottom land at one end of the pinion which, in the largest pinion, form web-like fillets between each tooth. Smaller pinions having fewer teeth may also be mounted in this manner by forming them with radially extending lugs aligned with each gear tooth at the end of the pinion having the web-like fillets. The outside diameter of the lug circle is substantially the outside diameter of the drawn cup. The radially extending cup tangs, equal in number to the number of teeth of the pinion are of sufficient axial length such that when staked over the web-like fillets, they seat adjacent the bottom land of the pinion and tightly retain the pinion within the drawn cup.

Thus it is the object of the instant invention to provide a pinion gear starter assembly utilizing a powdered metal pinion gear.

It is a further object of the instant invention to provide a pinion gear starter assembly utilizing a powdered metal pinion gear which is substantially dimensionally identical and interchangeable with conventional pinion gear starter assemblies.

It is a still further object of the instant invention to provide a pinion gear starter assembly utilizing a powdered metal pinion gear assembled to a drawn cup housing which does not utilize welding or brazing attachment means.

DESCRIPTION OF THE PREFERRED EMBODIMENT

Figure 1:
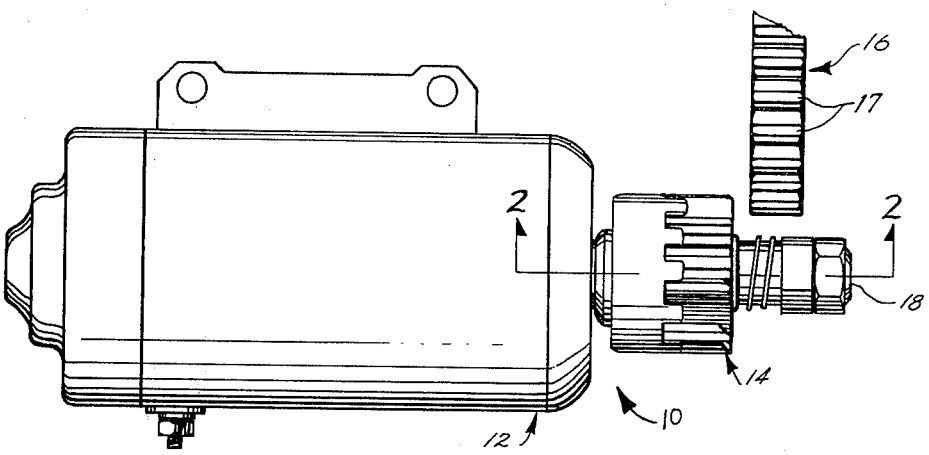
FIG. 1 is a fragmentary side elevational view of a starting motor and pinion gear starter assembly positioned on an internal combustion engine.
Figure 2:
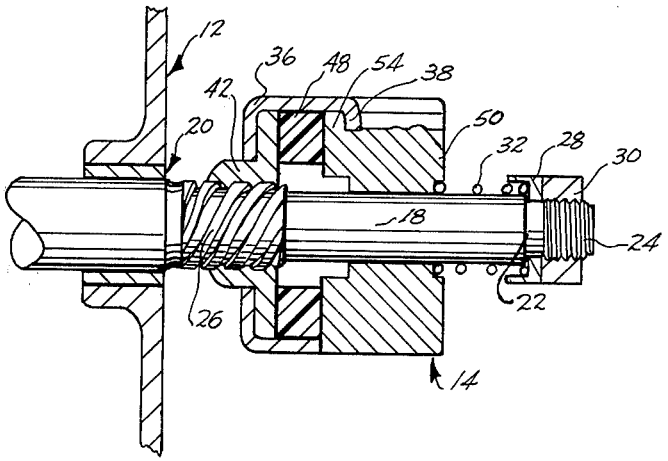
FIG. 2 is an enlarged full sectional view of a pinion gear starter assembly according to the instant invention as taken along line 2—2 of FIG. 1.

Referring now to FIGS. 1 and 2, an internal combustion engine starter assembly is generally designated by the reference 10. The starter assembly 10 comprises an electrically activated starting motor 12, a pinion assembly 14 and a flywheel 16. The flywheel or engine drive gear 16 is secured to the rotating output shaft of an internal combustion engine (not shown) and includes a plurality of gear teeth 17 disposed about its periphery. The starting motor 12 is preferably a direct current motor and provides rotary power to effect the starting of the internal combustion engine. Extending from one end of the starting motor 12 is an output shaft 18 which is rotatably positioned and centered within the starting motor 12 by at least one bearing assembly 20. The output shaft 18 is disposed parallel to and displaced radially from the axes of the flywheel 16 and drive shaft of the engine. Adjacent the terminus of the output shaft 18 is a shoulder 22 and a reduced diameter region which includes male theads 24 on a portion of its length most proximate the terminus of the shaft 18. Disposed on the output shaft 18 intermediate the bearing 20 and the shoulder 22 is a male helical spline 26. Positioned on the output shaft 18 and adjacent the shoulder 22 is a washer 28 which is retained tightly against the shoulder 22 by a conventional threaded fastener such as a nut 30. Disposed concentrically about the output shaft 18 and positioned between the washer 28 and the pinion assembly 14 is a helical compression spring 32. The compression spring 32 produces a biasing force against the pinion assembly 14 which urges it to the left as viewed in FIGS. 1 and 2, out of engagement with the flywheel gear teeth 17.

Figures 3, 4, 5, 6, 7, 8, 9:
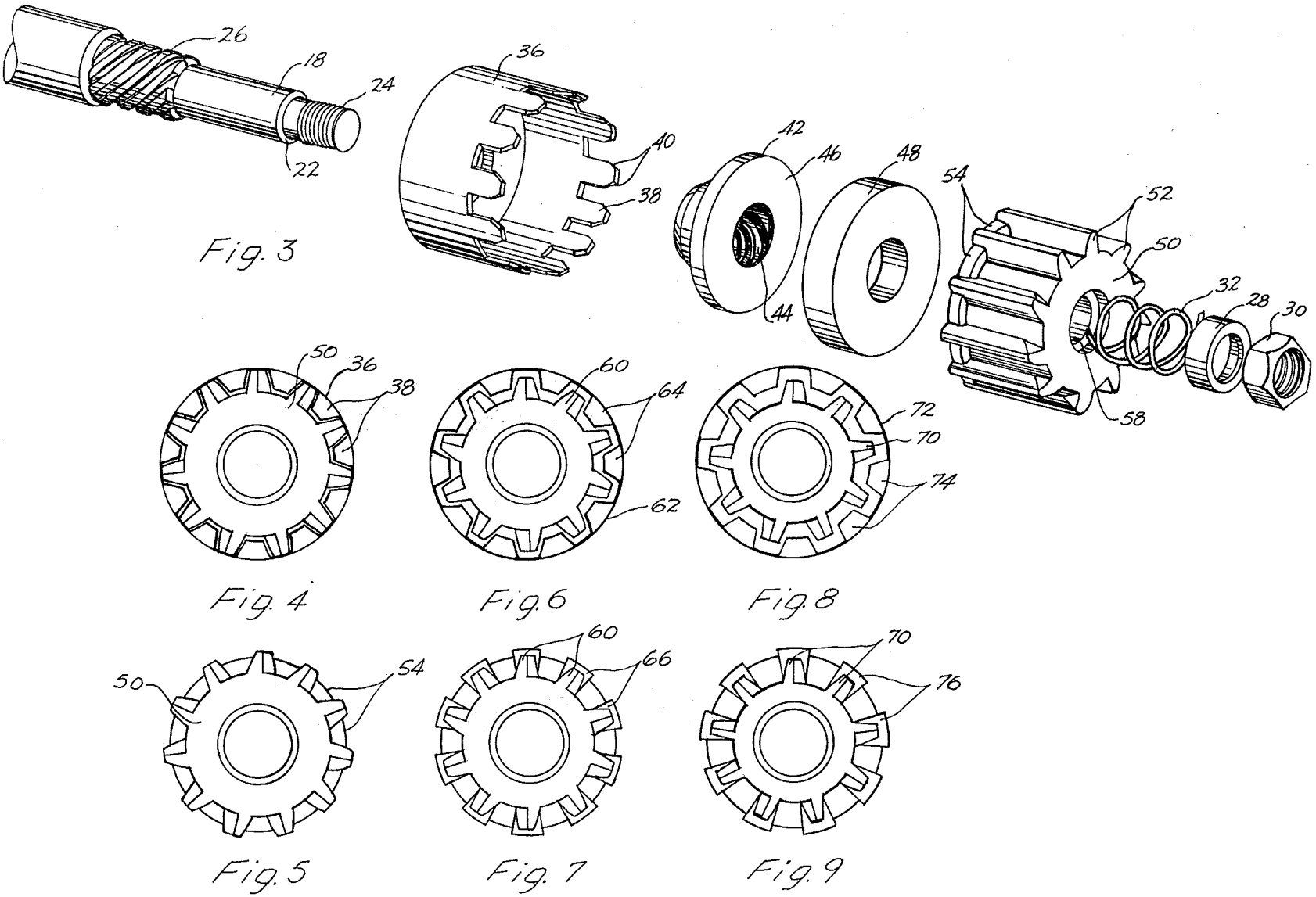
FIG. 3 is an exploded perspective view of a pinion gear starter assembly according to the instant invention.
FIG. 4 is an end elevational view of an eleven tooth pinion gear starter assembly according to the instant invention.
FIG. 5 is an end elevational view of an eleven tooth pinion gear of a pinion gear starter assembly according to the instant invention.
FIG. 6 is an end elevational view of a ten tooth pinion gear starter assembly according to the instant invention.
FIG. 7 is an end elevational view of a ten tooth pinion gear of a pinion gear starter assembly according to the instant invention.
FIG. 8 is an end elevational view of a nine tooth pinion gear starter assembly according to the instant invention.
FIG. 9 is an end elevational view of a nine tooth pinion gear of a pinion gear starter assembly according to the instant invention.

Referring now to FIGS. 2 and 3, the pinion assembly 14 comprises an outer deep drawn castellated cup 36 having a plurality of axially extending tangs 38 formed about its periphery. The profile and number of the tangs 38 are determined by other elements of the pinion assembly 14 and these considerations will be discussed subsequently. Positioned concentrically within the castellated cup 36 and about the output shaft 18 is a drive collar 42 which defines a female helical spline 44. The female helical spline 44 is complementary to and mates with the male helical spline 26 on the output shaft 18. The drive collar 42 also includes a flat radial surface 46 which is in contact with a clutch torus 48. The clutch torus 48 has a rectangular cross section and is preferably fabricated of a resilient material such as rubber. The pinion assembly 14 also includes a pinion 50 disposed concentrically within the castellated cup 36 and coaxially to the output shaft 18. The pinion 50 includes a plurality of gear teeth 52 and a like number of fillets 54 disposed in the interstice between the gear teeth 52 and extending radially outwardly from the bottom land of the pinion 50 adjacent one of its ends. The pinion 50 also includes an axial opening 58 disposed concentrically within the pinion 50 which receives the output shaft 18.

The assembly of the pinion assembly 14 is straightforward. The pinion 50 is produced by a conventional powdered metallurgy process wherein finely divided metallic particles are compressed into the shape of the pinion 50 and heated (sintered). The castellated cup 36, a drive collar 42 and resilient torus 48 are produced by conventional manufacturing processes such as deep drawing, punching and forging which form no part of the instant invention. These components are assembled as illustrated in FIGS. 2 and 3 and the tangs 38 of the castellated cup 36 are then staked over and against the fillets 54 of the gear pinion 50. It should be noted that the number of teeth 38 on the cup 36 are equal to the number of teeth 52 on the pinion 50 and that to ensure the proper seating of the tangs 38 between the gear teeth 52 and against the fillets 54, the tangs 38 should preferably include a beveled edge 40. The beveled edges 40 are generally cut in a manner assuring their substantial parallelism with the faces of the gear teeth 52 against which they are ultimately staked. The pinion assembly 14 is now complete and may be installed on the output shaft 18 of a starting motor 12 along with the compression spring 32 and the washer 28. These components may then be removably retained upon the output shaft 18 by the assembling and tightening of the nut 30 upon the output shaft 18.

FIG. 4 illustrates the pinion 50 having eleven teeth staked within the castellated cup 36 having a like number of tangs 38. FIG. 5 illustrates the pinion 50 independent of the cup 36. It should be noted that the diameter of the eleven tooth pinion 50 is substantially the same as the diameter of the castellated cup 36 and that the fillets 54 extend approximately midway between the bottom land and top land of the pinion 50. As noted previously, dimensional constraints of associated components establish the maximum diameter of the assembly 14 and the mounting means of the instant invention permits the utilization of a pinion 50 having an outer diameter substantially equal to the diameter of the cup 36, as is illustrated in FIG. 4.

FIGS. 6 and 7 illustrate a similar pinion 60 and a castellated cup 62 combination having but ten teeth. The cup 62 thus includes ten axially extending tangs 64 about its periphery. The diameter of the castellated cup 62 is the same as that of the castellated cup 36 illustrated in FIG. 4, however, due to the smaller diameter of the pinion 60, the axial length of each of the ten tangs 64 is preferably somewhat longer than the tangs 38 utilized with an eleven tooth pinion. As is illustrated in FIG. 7, the pinion 60 preferably includes a radially extending lug 66 associated with each gear tooth of the pinion 60 which assists the concentric alignment and securement of the pinion 60 to the castellated cup 62 by the tangs 64.

FIGS. 8 and 9 illustrate a further pinion 70 and castellated cup 72 combination having but nine teeth. The outer diameter of the teeth on the pinion 70 is smaller still and therefore a plurality of nine axially extending tangs 74 on the castellated cup 72 must be longer still than the tangs 64 and 38 of the ten tooth and eleven tooth pinions, respectively. The pinion 70 also preferably includes radially extending lugs 76 which facilitate the concentric and secure assembly of the pinion 70 within the castellated cup 72.

The foregoing disclosure is the best mode devised by the inventor for practicing this invention. It is apparent, however, that devices incorporating modifications and variations to the instant invention will be obvious to one skilled in the art of engine starter assemblies. Inasmuch as the foregoing disclosure is intended to enable one skilled in the pertinent art to practice the instant invention, it should not be construed to be limited thereby. Rather, the invention should be construed to include such aforementioned obvious variations and be limited only by the spirit and scope of the following claims.

What I claim is:

1. A starting motor pinion gear assembly comprising a cylindrical cup having an open end and a closed end, said closed end defining a concentrically disposed opening therethrough and said open end having a plurality of inwardly extending tangs disposed thereabout, a drive collar rotatably positioned within said cup and defining a helical splined opening therethrough, a pinion gear positioned within said cup and having teeth projecting radially outwardly from a bottom land and having inter-tooth fillets projecting radially outwardly from said bottom land at one end thereof, resilient clutch means frictionally coupling said drive collar to said pinion gear, and wherein said tangs extend inwardly between said pinion gear teeth and against said fillets of said pinion gear to retain said drive collar, said clutch and said one end of said pinion gear in said cup.

2. The starting motor pinion gear assembly of claim 1, wherein said cylindrical cup and said pinion gear have substantially equal outside diameters.

3. The starting motor pinion gear assembly of claim 1, wherein said drive collar has a smaller outside diameter than the inside diameter of said cup.

4. An engine cranking apparatus comprising, in combination, a starting motor having a shaft extending therefrom, said starting motor shaft including a helical spline along a portion of its length and a barrier disposed about said shaft, an engine drive gear, and a pinion gear assembly positioned to slide between engaged and disengaged positions on said starting motor shaft including a pinion gear having teeth, an end and a plurality of inter-tooth webs at said end, a drive collar defining a helically splined opening therethrough, clutch means frictionally coupling said collar and said pinion gear and a cylindrical castellated cup receiving and retaining said collar, said clutch means and said pinion gear, said cup having a closed end defining an opening aligned with said collar opening and having an open end defining a plurality of spaced tangs bent inwardly between said pinion gear teeth and against said webs, said tangs retaining said collar, said clutch and said pinion gear end in said cup, and wherein said helically splined collar opening engages said helically splined starting motor shaft and said pinion gear engages said engine drive gear when said pinion gear assembly is in said engaged position.

5. The engine cranking apparatus of claim 4, and further including a compression spring positioned about said shaft and disposed between said pinion gear assembly and said barrier.

6. The engine cranking apparatus of claim 4, wherein the outer diameter of said castellated cup means is substantially equal to the outer diameter of said pinion gear.

7. The engine cranking apparatus of claim 4, wherein said end of said pinion gear having said inter-tooth webs further includes a lug radially aligned with and extending beyond each tooth of said pinion gear.

8. An engine cranking apparatus comprising, in combination, a starting motor having a shaft extending therefrom, said starting motor shaft including a helical spline along a portion of its length and a barrier disposed about said shaft, an engine drive gear, a pinion gear assembly positioned to slide between engaged and disengaged positions on said starting motor shaft and a compression spring disposed on said shaft between said barrier and said pinion gear assembly to urge said pinion gear assembly toward said disengaged position, said pinion gear assembly including a pinion gear having a plurality of teeth, an end and a plurality of inter-tooth webs at said end and defining an opening therethrough, a drive collar defining a helically splined opening therethrough engaging said starter motor shaft spline, clutch means frictionally coupling said collar and said pinion gear, and a cylindrical castellated cup receiving and retaining said collar, said clutch means and said pinion gear, said cup having a closed end defining an opening aligned with said collar opening and a plurality of spaced tangs bent inwardly between said pinion gear teeth and against said webs of said pinion gear.

9. The engine cranking apparatus of claim 8, wherein said castellated cup and said pinion gear have substantially equal outer diameters.

10. The engine cranking apparatus of claim 8, wherein said end of said pinion gear having said inter-tooth webs further includes a lug radially aligned with and extending beyond each tooth of said pinion gear.

* * * * *